US008049441B2

(12) United States Patent
Zhong et al.

(10) Patent No.: US 8,049,441 B2
(45) Date of Patent: Nov. 1, 2011

(54) BALLAST CIRCUIT

(75) Inventors: Yuan-Yuan Zhong, Shanghai (CN); Wei-Qiang Zhang, Shanghai (CN); Jian-Ping Ying, Shanghai (CN)

(73) Assignee: Delta Electronics, Inc., Taoyuan Hsien (TW)

( * ) Notice: Subject to any disclaimer, the term of this patent is extended or adjusted under 35 U.S.C. 154(b) by 368 days.

(21) Appl. No.: 12/256,926

(22) Filed: Oct. 23, 2008

(65) Prior Publication Data

US 2009/0243508 A1 Oct. 1, 2009

(30) Foreign Application Priority Data

Mar. 26, 2008 (TW) ..... 97110792 A

(51) Int. Cl.
*H05B 37/00* (2006.01)
*G05F 1/00* (2006.01)

(52) U.S. Cl. ..... 315/312; 315/291

(58) Field of Classification Search ..... 315/241, 315/242, 243, 244, 291, 307, 312
See application file for complete search history.

(56) References Cited

U.S. PATENT DOCUMENTS

| | | | | |
|---|---|---|---|---|
| 5,546,300 | A * | 8/1996 | Lee et al. | 363/132 |
| 6,366,032 | B1 * | 4/2002 | Allison et al. | 315/307 |
| 6,400,095 | B1 * | 6/2002 | Primisser et al. | 315/224 |
| 7,042,161 | B1 * | 5/2006 | Konopka | 315/119 |
| 7,288,901 | B1 * | 10/2007 | Yu et al. | 315/291 |

* cited by examiner

*Primary Examiner* — Douglas W Owens
*Assistant Examiner* — Minh D A
(74) *Attorney, Agent, or Firm* — Holland & Knight LLP; Brian J Colandreo, Esq.; Mark H Whittenberger, Esq.

(57) ABSTRACT

A ballast circuit is provided. The ballast circuit comprises a first lamp set, a second lamp set, a detection circuit, and a latch circuit. The first lamp set comprises a first inductor and a plurality of containing areas. The second lamp set comprises a second inductor and at least one containing area. The detection circuit is configured to receive a direct current (DC) voltage and coupled to the containing areas of the first and second lamp sets so that the detection circuit, the first inductor, the second inductor, and a plurality of lamps contained in the containing areas are in a series connection and generate a first signal. The latch circuit is coupled to the detection circuit and configured to selectively start in response to the first signal.

18 Claims, 6 Drawing Sheets

BALLAST CIRCUIT

CROSS-REFERENCE TO RELATED APPLICATION

This application claims the benefit of priority based on Taiwan Patent Application No. 097110792 filed on 26 Mar. 2008, the contents of which are incorporated herein by reference in its entirety.

BACKGROUND OF THE INVENTION

1. Field of the Invention

The present invention relates to a ballast circuit. More specifically, the present invention relates to a ballast circuit capable of detecting and automatically restarting all lamps.

2. Descriptions of the Related Art

Lamps have found more and more widespread applications since the advent thereof. One of the most widespread and well-known applications is lighting. As increasingly heightened requirements are being imposed on the lighting effect, ballasts with a plurality of lamps have been used wider than that with one lamp.

Please refer to FIG. 1, where a conventional ballast circuit 1 is illustrated. The ballast circuit 1 comprises a first lamp set 11, a second lamp set 12, a drive circuit 13, capacitors 150, 151, switches 152, 153, a detection circuit, a latch circuit 140, and preheat circuits 160, 161. The lamp set 11 comprises a resonant module 110, preheat circuits 111, 112 and two containing areas (not shown) for receiving the lamps 113, 114 respectively. The second lamp set 12 comprises a resonant module 120, preheat circuits 121, 122 and two containing areas (not shown) for receiving the lamps 123, 124 respectively. The drive circuit 13 is configured to start the switches 152, 153 of the ballast circuit 1. Various elements of the ballast circuit 1 are well known to those of ordinary skill in the art, and thus only those relevant to this invention will be described.

As the number of lamps contained in the ballast circuit 1 increases, the lighting effect gets significantly improved. However, there are some shortcomings arisen in the ballast circuit containing a plurality of lamps. One of the shortcomings is that not all lamps can be detected whether they have been connected into the circuit. More specifically, the detection circuit of the ballast circuit 1 comprises a capacitor 141 and resistors 142, 143, 144. The resistor 142 is connected to a direct current (DC) voltage input terminal 163 and a filament of the lamp 114. The resistor 143 is connected to a filament of the lamp 124 and the latch circuit 140. The resistor 144 is connected to the resistor 143 and the latch circuit 140.

As the detection circuit is connected to the lamps 114, 124 and the latch circuit 140, the latch circuit 140 may determine whether the lamps 114, 124 have been connected into the circuit according to a voltage at a juncture 17. More particularly, in case either or both of the lamps 114, 124 fail to be connected into the circuit, the juncture 17 will experience a voltage drop so that the ballast circuit 1 can determine that the lamp(s) has not been connected into the circuit. Once all the lamps have been connected into the circuit, the voltage at the juncture 17 will be restored to a normal value, and the drive circuit 13 can restart the lamps.

It follows from the above descriptions that the detection circuit equipped in the ballast circuit 1 is only able to detect whether a portion of the lamps (i.e., lamps 114, 124) has been connected to the circuit or not, but fails to detect whether all of the lamps (i.e., fails to detect the lamps 111, 121) have been connected to the circuit or not. Consequently, the aforementioned ballast circuit is inconvenient for users.

In summary, efforts still have to be made in the art to provide a ballast circuit capable of detecting if all lamps have been connected into the circuit.

SUMMARY OF THE INVENTION

One objective of this invention is to provide a ballast circuit capable of detecting if lamps mounted therein have all been connected into the circuit.

To this end, the ballast circuit of the present invention comprises a first lamp set, a second lamp set, a detection circuit and a latch circuit. The first lamp set comprises a first inductor and a plurality of containing areas. Each of the containing areas is adapted to contain a lamp so that the lamps are connected in series. The containing areas are connected in series with the first inductor. The second lamp set, which is connected in parallel with the first lamp set, comprises a second inductor and at least one containing area. The second inductor is connected to the first inductor, and the at least one containing area is connected in series with the second inductor. Each of the at least one containing area is adapted to contain a lamp so that the at least one lamp is connected in series with the second inductor. The detection circuit is connected to each of the containing areas of the first lamp set and each of the containing areas of the second lamp set, so that the detection circuit, the first inductor, the second inductor, and the lamps contained in the containing areas form a series connection. The detection circuit is configured to receive a DC voltage signal and generate a first signal. The latch circuit, which is coupled to the detection circuit, is configured to selectively start the ballast circuit in response to the first signal.

The ballast circuit has the detection circuit coupled to all the containing areas of the ballast circuit. Consequently, when lamps are contained in the ballast circuit, the detection circuit will also be coupled to all the lamps. As all the lamps are coupled to the detection circuit, the ballast circuit is capable of determining status of the lamps according to a voltage on the detection circuit, so that the latch circuit thereof will open or close the ballast circuit in response to the voltage on the detection circuit.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

In the following descriptions, the present invention will be explained with reference to embodiments thereof. However, these embodiments are not intended to limit that this invention can only be embodied in any specific context, applications, or with particular methods described in these embodiments. Therefore, description of these embodiments is only intended to illustrate rather than to limit this invention. It should be noted that in the following embodiments and the attached drawings, elements unrelated to this invention are omitted and not drawn, and relationships among individual elements are only illustrated to facilitate understanding rather than to limit the actual scales.

Figure 1:
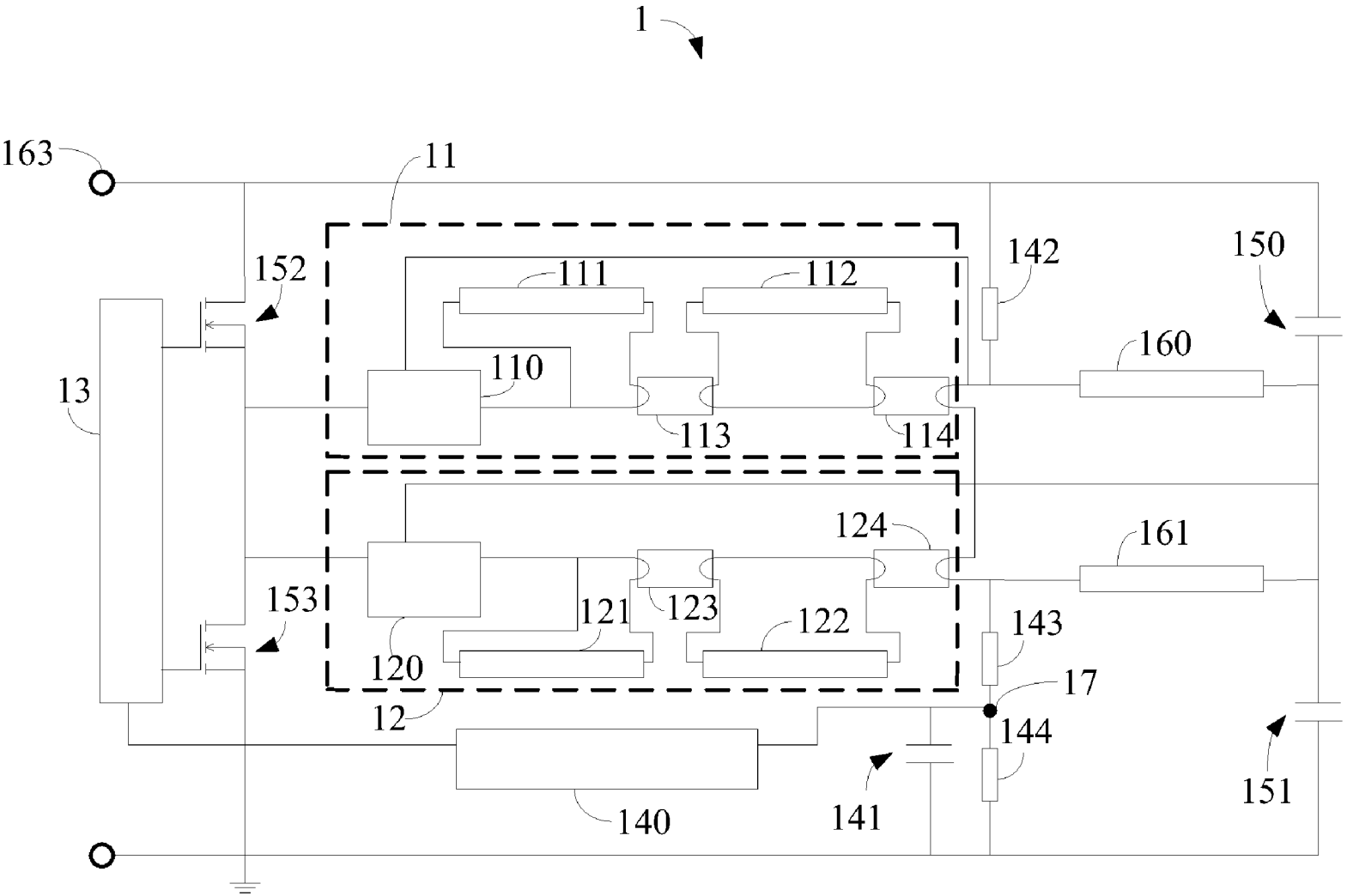
FIG. 1 (Prior Art)
FIG. 1 is a schematic view of a conventional ballast circuit.
Figure 2:
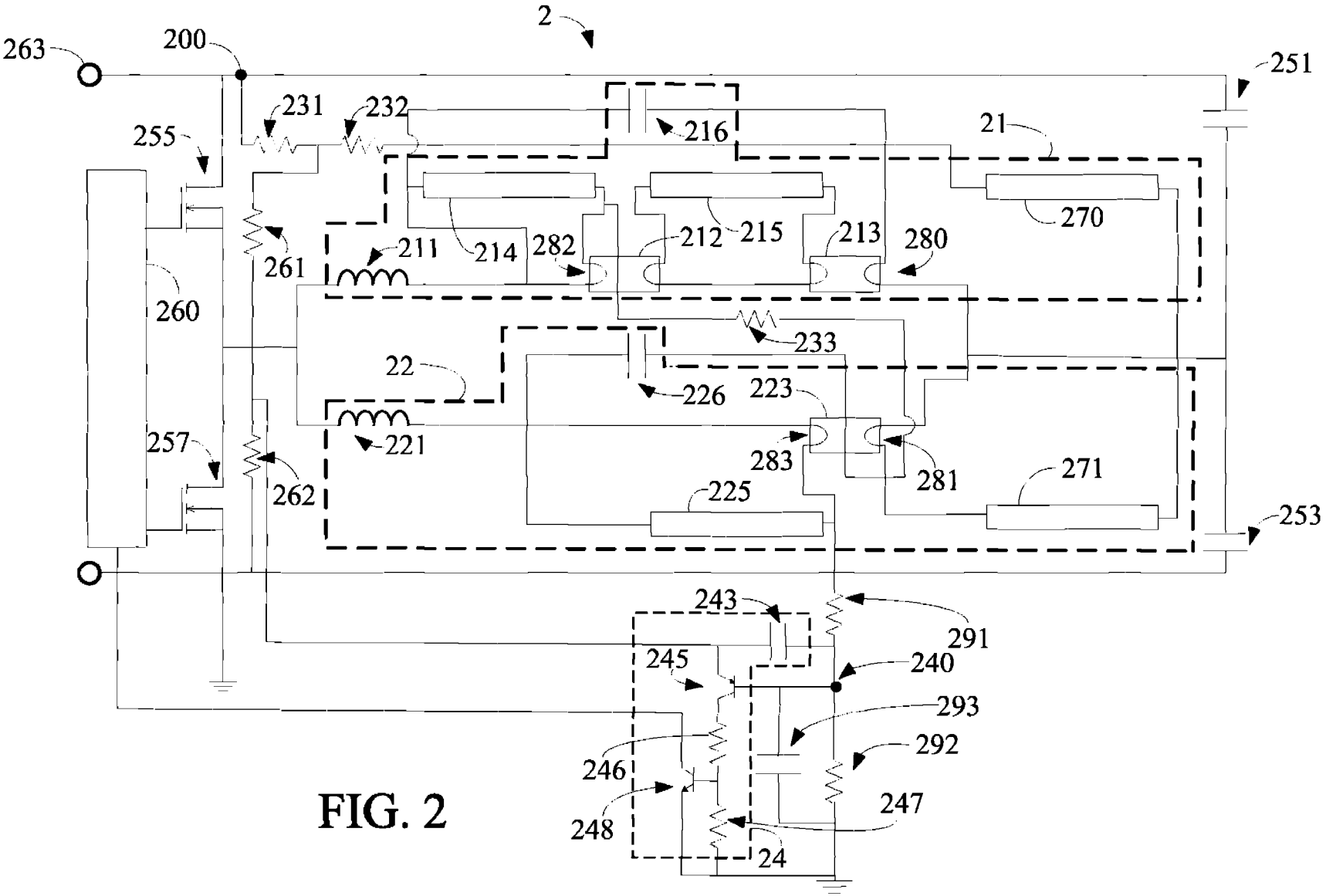
FIG. 2 is a schematic view of a first preferred embodiment of the present invention.

FIG. 2 illustrates a first preferred embodiment of the present invention, which is a ballast circuit 2. The ballast circuit 2 comprises a first lamp set 21, a second lamp set 22, a detection circuit, a latch circuit 24, capacitors 251, 253, and switches 255, 257.

Each of the switches 255, 257 has a control terminal, a first terminal, and a second terminal. Each of the capacitors 251, 253 has a first terminal and a second terminal. The control terminals of the switches 255, 257 are connected to a drive circuit 260. The first terminal of the switch 255 is coupled to the first terminal of the capacitor 251. The second terminal of the switch 255 is coupled to the first terminal of the switch 257. The second terminal of the switch 257 is grounded and coupled to the second terminal of the capacitor 253. The second terminal of the capacitor 251 is coupled to the first terminal of the capacitor 253. The first lamp set 21 is coupled to the second terminal of the switch 255, the first terminal of the switch 257, the second terminal of the capacitor 251, and the first terminal of the capacitor 253. The second lamp set 22 is also coupled to the second terminal of the switch 255, the first terminal of the switch 257, the second terminal of the capacitor 251, and the first terminal of the capacitor 253.

The first lamp set 21 comprises a first inductor 211, a first capacitor 216, a first containing area (not shown) for containing a first lamp 212, a second containing area (not shown) for containing a second lamp 213, and a plurality of preheat circuits 214, 215, 270. These containing areas are connected in series with the first inductor 211. Specifically, the first containing area is coupled in series to the first inductor 211 and the second containing area is coupled to the first containing area, so that the first lamp 212 and the second lamp 213 contained therein are connected in series. The first capacitor 216 is coupled/connected to the last containing area of the first lamp set 21 (i.e., the second containing area), and thus also coupled/connected to the lamp contained therein (i.e. the second lamp 213). Meanwhile, the first capacitor 216 is also coupled to the first inductor 211. The first inductor 211 and the first capacitor 216 are adapted to form a resonant circuit in the first lamp set 21; functions and effects of the resonant circuit will be readily appreciated by those of ordinary skill in the art and thus will not be described in details. The preheat circuit 214 is coupled to the first inductor 211 and the first containing area, and thus is also coupled to the first lamp 212 contained therein. The preheat circuit 215 is coupled to the first containing area and the second containing area, and thus is also coupled to the first lamp 212 and the second lamp 213 contained therein. The preheat circuit 270 is coupled to the second containing area, and thus is also coupled to the second lamp 213 contained therein. The preheat circuits 214, 215, 270 are configured to preheat the first lamp 212 and the second lamp 213 when the ballast circuit 2 is just started.

On the other hand, the second lamp set 22 is connected in parallel with the first lamp set 21, and comprises a second inductor 221, a second capacitor 226, a third containing area (not shown) for containing a third lamp 223, and a plurality of preheat circuits 225, 271. The second inductor 221 is coupled to the first inductor 211, and the third containing area is connected in series with the second inductor 221, so that the third lamp 223 contained in the third containing area is also connected in series with the second inductor 221. The second capacitor 226 is coupled/connected to the last containing area of the second lamp set 22 (i.e. the containing area for the third lamp 223), and is thus also coupled to the third lamp 223 contained therein. Meanwhile, the second capacitor 226 is also coupled to the second inductor 221. The second inductor 221 and the capacitor 226 are adapted to form a resonant circuit in the second lamp set 22. The preheat circuit 225 is coupled to the second inductor 221 and the third containing area, and thus is also coupled to the third lamp 223 contained therein. The preheat circuit 271 is coupled to the third containing area, and thus is also coupled to the third lamp 223 contained therein. The preheat circuit 271 is further coupled to the preheat circuit 270. The preheat circuits 225, 271 are configured to preheat the third lamp 223 when the ballast circuit is just started.

The detection circuit is coupled to each of the containing areas (i.e., the first and the second containing areas) of the first lamp set 21 and each of the containing areas (i.e., the third containing area) of the second lamp set 22. Furthermore, the detection circuit, the first inductor 211, the second inductor 221, the first lamp 212 contained in the first containing area, the second lamp 213 contained in the second containing area and the third lamp 223 contained in the third containing area form a series connection, details of which will be set forth later. Additionally, the detection circuit is connected to a juncture 200, which is the DC voltage input terminal 263 of the ballast circuit 2 in this embodiment, to receive a DC voltage signal for use to detect the status of the lamps—whether all the lamps have been connected into the circuit or not. In other embodiments, the DC voltage input terminal 263 may also be replaced by other DC voltage input terminals while still achieving the same objective as this preferred embodiment; this will be readily appreciated by those of ordinary skill in the art with reference to this preferred embodiment, and thus will not be described again.

Particularly, the first lamp 212 of the first lamp set 21 is coupled to the first inductor 211. The second lamp 213 is coupled to the first lamp 212. The third lamp 223 of the second lamp set 22 is coupled to the second inductor 221 and the second lamp 213. The detection circuit comprises three detection sub-circuits, namely, the first detection sub-circuit, the second detection sub-circuit and the third detection sub-circuit.

Specifically, the first detection sub-circuit is coupled to the second containing area and a DC voltage input terminal (e.g., the juncture 200) to receive a DC voltage. Further, when the second lamp 213 is contained in the second containing area, the first detection sub-circuit is also coupled to the second lamp 213. It can be seen from FIG. 2 that the first detection sub-circuit comprises the juncture 200, the first resistor 231, and the second resistor 232 in a series connection, where the second resistor 232 is connected in series with the first resistor 231. Hence, the first detection sub-circuit is coupled to the DC input terminal and the second containing area via the first resistor 231 and the second resistor 232 respectively.

The second detection sub-circuit is coupled to the first containing area and the third containing area. Further, when the first containing area and the third containing area have the first lamp 212 and the third lamp 223 contained therein respectively, the second detection sub-circuit is also coupled to the first lamp 212 and the third lamp 223. It can be seen from FIG. 2 that the second detection sub-circuit comprises a third resistor 233, via which the second detection sub-circuit is coupled to the first and the third containing areas. Additionally, the first detection sub-circuit and the second detection sub-circuit are connected in series via a filament 280 of the second lamp 213 and a filament 281 of the third lamp 223.

The third detection sub-circuit is coupled to the third containing area and the latch circuit 24. It can be seen from FIG. 2 that the third detection sub-circuit comprises a fifth resistor 291, a sixth resistor 292, and a detection capacitor 293. The fifth resistor 291 is connected to the latch circuit 24 and the third containing area. The sixth resistor 292 is connected to the latch circuit 24 and the fifth resistor 291. The detection capacitor 293 is connected to the latch circuit 24 and the fifth resistor 291 and connected in parallel with the sixth resistor 292. Consequently, the third detection sub-circuit is coupled to the third containing area and the latch circuit 24 via the fifth resistor 291, the sixth resistor 292, and the detection capacitor 293. When the third containing area has the third lamp 223 contained therein, the fifth resistor 291 of the third detection sub-circuit is also coupled to the third lamp 223. The second detection sub-circuit is connected in series with the third detection sub-circuit via the filament 282 of the first lamp 212, the first inductor 211, the second inductor 221, and a filament 283 of the third lamp 223.

In other words, the juncture 200, the first resistor 231, the second resistor 232, the second lamp 213, the third lamp 223, the third resistor 233, the first lamp 212, the first inductor 211, the second inductor 221, and the other side of the third lamp 223 are connected to the latch circuit 24 in series to form the aforementioned series circuit.

In the following descriptions, how the detection circuit detects whether all of the lamps (i.e., the first lamp 212, the second lamp 213, and the third lamp 223) are connected into the circuit and how the ballast circuit 2 is restarted will be explained. The latch circuit 24 comprises resistors 246, 247, a capacitor 243, and switches 245, 248, and the connections among which are illustrated in FIG. 2. In this preferred embodiment, the switch 245 is a PNP-type transistor, and the switch 248 is an NPN-type transistor. In other embodiments, the switches 245 and 248 may be replaced by other switches having the same properties.

The detection circuit is connected to a DC voltage input terminal (e.g., the juncture 200) to receive a DC voltage and generate a first signal at a juncture 240 between the fifth resistor 291 and the sixth resistor 292. The switches 245 and 248 of the latch circuit 24 are turned on or off in response to the first signal, so that the drive circuit 260 is able to turn off or restart all the lamps in the ballast circuit 2. For example, in the event that a lamp of the ballast circuit 2 is not connected into the circuit, the first signal at the juncture 240 will have a voltage value lower than a first predetermined voltage value, in which case the switch 245 will be turned on. Once the switch 245 is turned on, a voltage value at the juncture of the resistor 246 and the resistor 247 is higher than a second predetermined voltage value to turn on the switch 248 and further latch the drive circuit 260. Upon replacement of the lamp(s), a voltage higher than or equal to a third predetermined voltage value will occur at the juncture 240 so that the switch 245 is turned off. As a consequence, the switch 248 is also turned off. Then the ballast circuit resumes normal operation. Herein, the third predetermined voltage value may be equal to the first predetermined voltage value.

It follows from the above descriptions that in the detection circuit of the first preferred embodiment, the first, second, and third detection sub-circuits connect the first lamp 212 contained in the first containing area, the second lamp 213 contained in the second containing area, the third lamp 223 contained in the third containing area, the first inductor 211 and the second inductor 212 into a series circuit. Since all the lamps (i.e., the first lamp 212, the second lamp 213 and the third lamp 223) are disposed in the series circuit, failure of any of the lamps will change the operation status of the latch circuit 24. With the arrangement of the first preferred embodiment, the problem that the status of only a portion of the lamps can be detected is solved.

Figure 3:
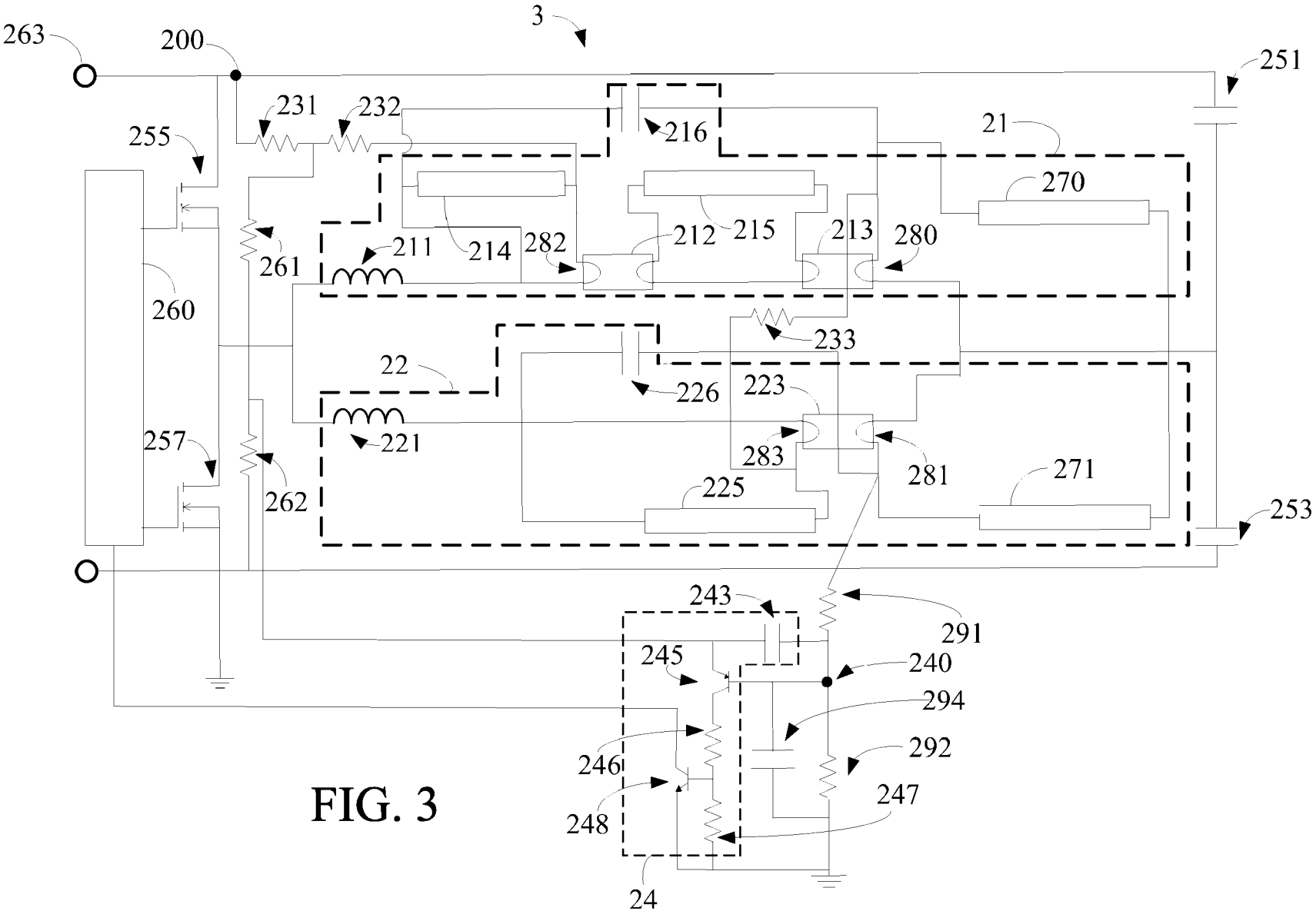
FIG. 3 is a schematic view of a second preferred embodiment of the present invention.

FIG. 3 illustrates a second preferred embodiment of the present invention, which is a ballast circuit 3. The ballast circuit 3 also comprises a first lamp set 21, a second lamp set 22, a detection circuit, a latch circuit 24, capacitors 251, 253, and switches 255, 257. The first lamp set 21, the second lamp set 22, the latch circuit 24, the capacitors 251, 253, the switches 255, 257, and connections between them are just the same as those of the ballast circuit 2 of the first embodiment, and thus will be omitted from description herein. The following descriptions will focus on differences between the second embodiment and the first embodiment, i.e., connections of the detection circuit.

Likewise, the detection circuit of the ballast circuit 3 comprises three detection sub-circuits, namely, the first detection sub-circuit, the second detection sub-circuit, and the third detection sub-circuit. The first detection sub-circuit is coupled to the first containing area and a DC voltage input terminal (e.g., the juncture 200, which is connected to the DC voltage input terminal 263) to receive a DC voltage. Further, when the first containing area has the first lamp 212 contained therein, the first detection sub-circuit is also coupled to the first lamp 212. It can be seen from FIG. 3 that the first detection sub-circuit comprises the juncture 200, the first resistor 231, and the second resistor 232 in a series connection, wherein the second resistor 232 is connected in series with the first resistor 231. Hence, the first detection sub-circuit is coupled to the DC input terminal and the first containing area via the first resistor 231 and the second resistor 232 respectively.

The second detection sub-circuit is coupled to the second containing area and the third containing area. Further, when the second containing area and the third containing area have the second lamp 213 and the third lamp 223 contained therein respectively, the second detection sub-circuit is also coupled to the second lamp 213 and the third lamp 223. It can be seen from FIG. 3 that the second detection sub-circuit comprises a third resistor 233, via which the second detection sub-circuit is coupled to the second and third containing areas. Additionally, the second detection sub-circuit is connected in series with the first detection sub-circuit via the filament 283 of the third lamp 223, the first inductor 211, the second inductor 221, and the filament 282 of the first lamp 212.

The third detection sub-circuit is coupled to the third containing area and the latch circuit 24. It can be seen from FIG. 3 that the third detection sub-circuit comprises a fifth resistor 291, a sixth resistor 292, and a detection capacitor 294. The fifth resistor 291 is connected to the latch circuit 24 and the third containing area. The sixth resistor 292 is connected to the latch circuit 24 and the fifth resistor 291. The detection capacitor 294 is connected to the latch circuit 24 and the fifth resistor 291 and connected in parallel with the sixth resistor 292. Consequently, the third detection sub-circuit is coupled to the third containing area and the latch circuit 24 via the fifth resistor 291, the sixth resistor 292, and the detection capacitor 294.

In other words, when the third containing area has the third lamp 223 contained therein, the third detection sub-circuit is also coupled to the third lamp 223. The third detection sub-circuit is connected in series with the second detection sub-circuit via the filament 281 of the third lamp 223 and the filament 280 of the second lamp 213. As a result, the juncture 200, the first resistor 231, the second resistor 232, the filament 282 of the first lamp 212 contained in the first containing area, the first inductor 211, the second inductor 221, the filament 283 of the third lamp 223 contained in the third containing area, the third resistor 233, the filament 280 of the second lamp 213 contained in the second containing area, and the filament 281 of the third lamp 223 are connected in series with the latch circuit 24 to form the aforementioned series circuit.

According to aforementioned descriptions, in a different way from that of the first embodiment, the detection circuit of the second preferred embodiment cascades the first lamp 212, the second lamp 213, the third lamp 223, the first inductor 211 and the second inductor 212 into a series circuit. Since all the lamps (i.e., the first lamp 212, the second lamp 213 and the third lamp 223) are disposed in the series circuit, the status that if any of the lamps is not connected to the circuit will change the operation status of the latch circuit 24.

Figure 4:
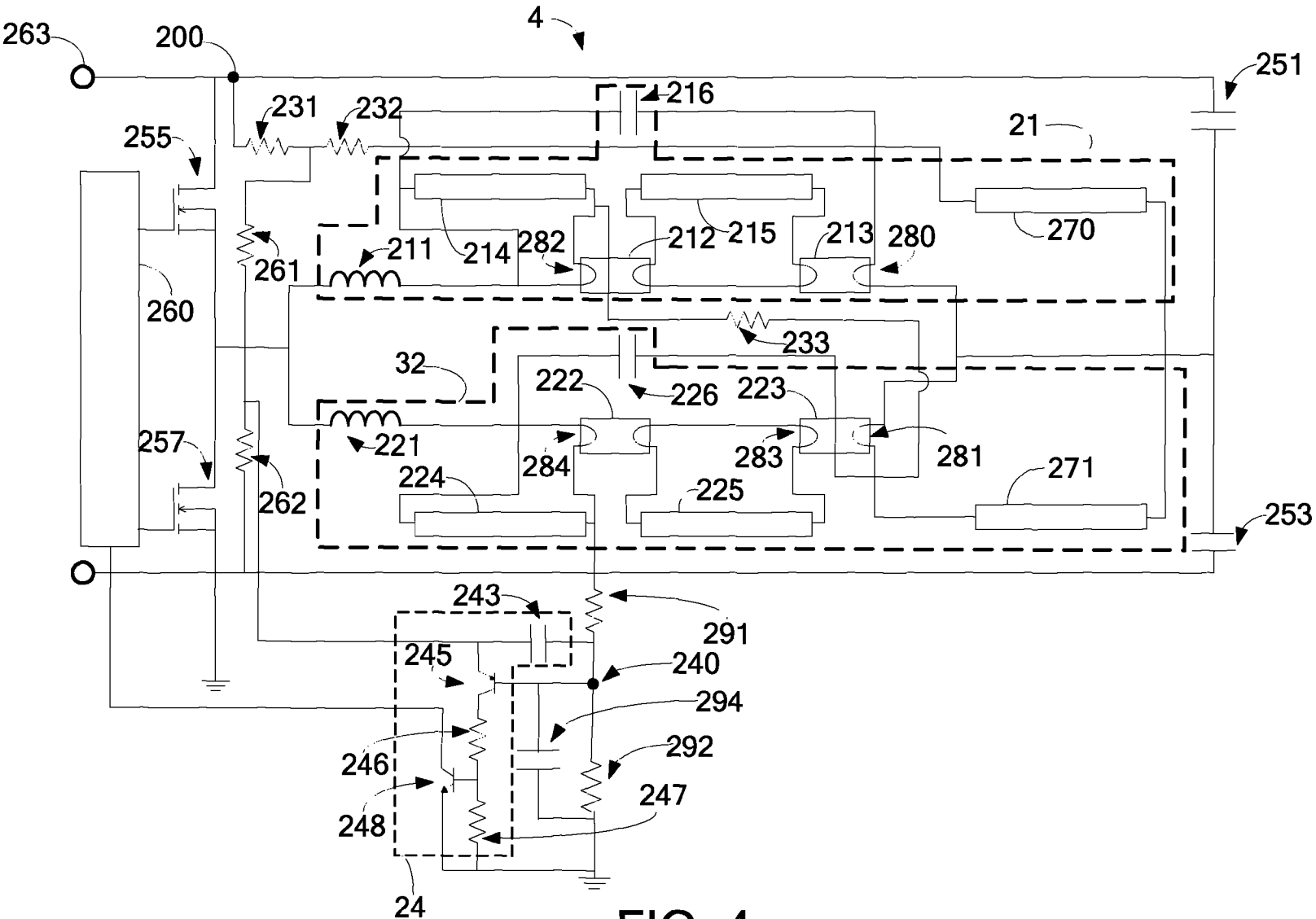
FIG. 4 is a schematic view of a third preferred embodiment of the present invention.

FIG. 4 illustrates a third preferred embodiment of the present invention, which is a ballast circuit 4. The ballast circuit 4 comprises a first lamp set 21, a second lamp set 32, a detection circuit, a latch circuit 24, capacitors 251, 253, and switches 255, 257. The first lamp set 21, the latch circuit 24, the capacitors 251, 253, the switches 255, 257 and their connections are just the same as those described in the ballast circuit 2 of the first preferred embodiment, and thus will be omitted from description herein. The following description will focus on differences between this embodiment and the first embodiment.

The first difference between the ballast circuit 4 and the ballast circuit 2 of the previous preferred embodiment is in that the second lamp set 32 further comprises a preheat circuit 224 and a fourth containing area for containing a fourth lamp 222. The containing areas (i.e., the third and fourth containing areas) included in the second lamp set 32 are connected in series with the second inductor 221, so that the third lamp 223 and the fourth lamp 222 contained in the containing areas (i.e., the third and the fourth containing areas) of the second lamp set 32 are connected in series with the second inductor 221.

Specifically, the fourth containing area is coupled to the second inductor 221, and when the fourth containing area has the fourth lamp 222 contained therein, the fourth lamp 222 will also be coupled to the second inductor 221. The third lamp 223 is coupled to the fourth lamp 222 and the second lamp 213. Both the preheat circuits 224, 225 are coupled to the fourth containing area, i.e., coupled to the fourth lamp 222 contained in the fourth containing area simultaneously. The preheat circuits 224, 225 are configured to preheat the fourth lamp 222 when the ballast circuit 4 is just started.

The second difference between the ballast circuit 4 and the ballast circuit 2 of the previous preferred embodiment lies in connections of the detection circuit. The detection circuit of the ballast circuit 4 comprises three detection sub-circuits, namely, the first detection sub-circuit, the second detection sub-circuit, and the third detection sub-circuit. The first detection sub-circuit is coupled to the second containing area and a DC voltage input terminal (e.g., the juncture 200, which is coupled to the DC voltage input terminal 263) to receive a DC voltage. Further, when the second containing area has the second lamp 213 contained therein, the first detection sub-circuit is also coupled to the second lamp 213. It can be seen from FIG. 4 that the first detection sub-circuit comprises the first resistor 231 and the second resistor 232 connected in series. Hence, the first detection sub-circuit is coupled to the DC input terminal and the second containing area via the first resistor 231 and the second resistor 232 respectively.

The second detection sub-circuit is coupled to the first containing area and the third containing area. Further, when the first containing area and the third containing area have the first lamp 212 and the third lamp 223 contained therein respectively, the second detection sub-circuit is also coupled to the first lamp 212 and the third lamp 223. It can be seen from FIG. 4 that the second detection sub-circuit comprises a third resistor 233, via which the second resistor 232 is coupled to the first and third containing areas. Additionally, the second detection sub-circuit is connected in series with the first detection sub-circuit via the filament 281 of the third lamp 223 and the filament 280 of the second lamp 213.

The third detection sub-circuit is coupled to the fourth containing area and the latch circuit 24. It can be seen from FIG. 4 that the third detection sub-circuit comprises a fifth resistor 291, a sixth resistor 292, and a detection capacitor 294. The fifth resistor 291 is connected to the latch circuit 24 and the fourth containing area. The sixth resistor 292 is connected to the latch circuit 24 and the fifth resistor 291. The detection capacitor 294 is connected to the latch circuit 24 and the fifth resistor 291 and connected in parallel with the sixth resistor 292. Consequently, the third detection sub-circuit is coupled to the fourth containing area and the latch circuit 24 via the fifth resistor 291, the sixth resistor 292, and the detection capacitor 294.

In other words, when the fourth containing area has the fourth lamp 222 contained therein, the third detection sub-circuit is also coupled to the fourth lamp 222. The second detection sub-circuit is connected in series with the third detection sub-circuit via the first inductor 211 and the second inductor 221. In other words, the juncture 200, the first resistor 231, the second resistor 232, the filament 280 of the second lamp 213 contained in the second containing area, the filament 281 of the third lamp 223 contained in the third containing area, the third resistor 233, the filament 282 of the first lamp 212 contained in the first containing area, the first inductor 211, the second inductor 221, the filament 284 of the fourth lamp 222 contained in the fourth containing area, and the latch circuit 24 are connected together to form the aforementioned series circuit.

According to the aforementioned descriptions, by use of the first inductor 211 and the second inductor 212, the detection circuit cascades all lamps contained in the containing areas into a series circuit no matter how many containing areas are included in the first and second lamp sets. Consequently, failure of any of the lamps will change the operation status of the latch circuit 24.

Figure 5:
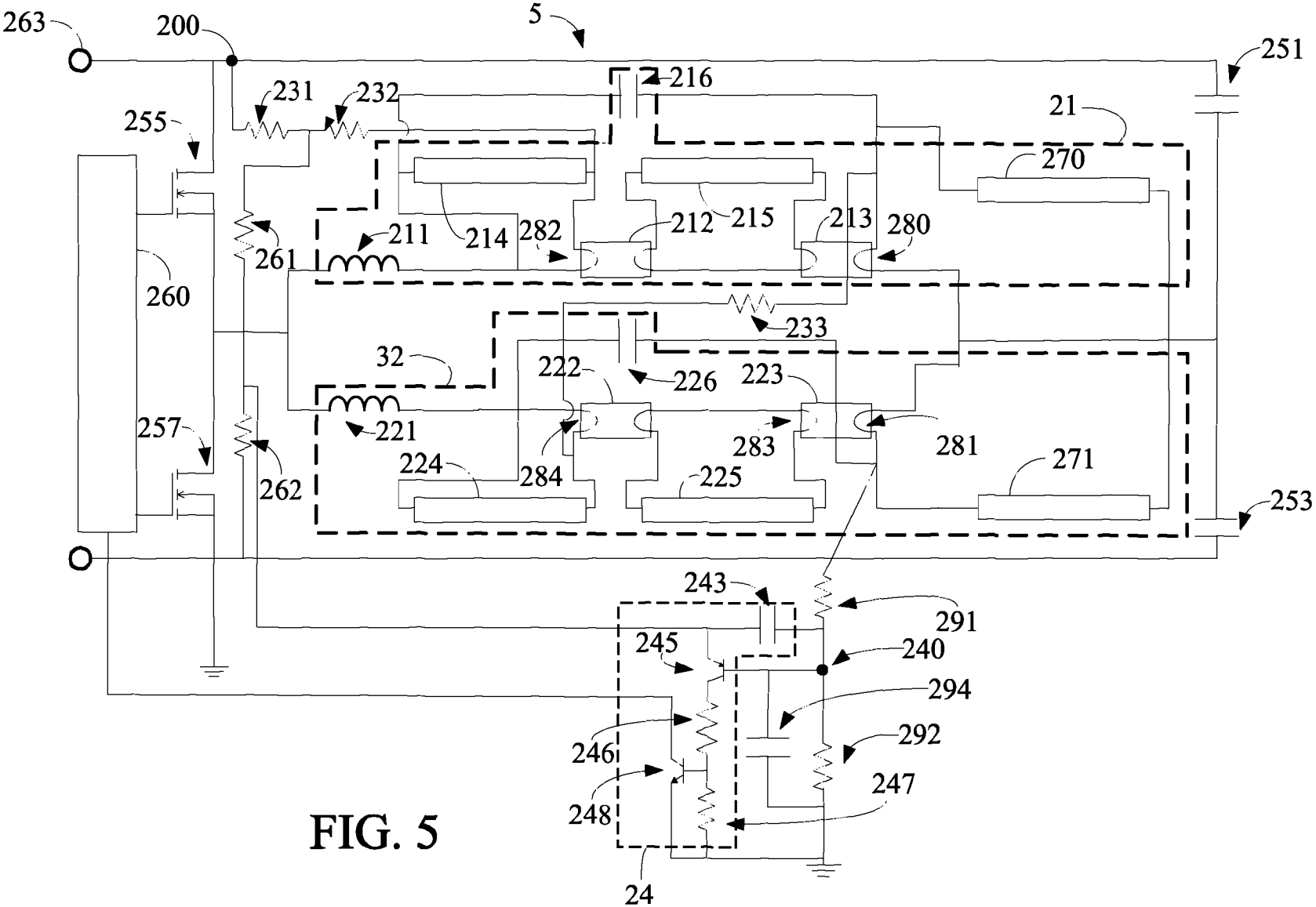
FIG. 5 is a schematic view of a fourth preferred embodiment of the present invention.

FIG. 5 illustrates a fourth preferred embodiment of the present invention, which is a ballast circuit 5. The ballast circuit 5 also comprises a first lamp set 21, a second lamp set 32, a detection circuit, a latch circuit 24, capacitors 251, 253, and switches 255, 257. The first lamp set 21, the second lamp set 32, the latch circuit 24, the capacitors 251, 253, the switches 255, 257, and their connections are just the same as those of the ballast circuit 4, and thus will be omitted and not described again. The following descriptions will focus on differences between the ballast circuit 5 and the ballast circuit 4. The difference between the ballast circuit 5 and the ballast circuit 4 lies in connections of the detection circuit. Likewise, the detection circuit of the ballast circuit 5 comprises three detection sub-circuits, namely, the first detection sub-circuit, the second detection sub-circuit, and the third detection sub-circuit.

The first detection sub-circuit is coupled to the first containing area and a DC voltage input terminal (e.g., the juncture 200, which is coupled to the DC voltage input terminal 263) to receive a DC voltage. Further, when the first containing area has the first lamp 212 contained therein, the first detection sub-circuit is also coupled to the first lamp 212. It can be seen from FIG. 5 that the first detection sub-circuit comprises the first resistor 231 and the second resistor 232 connected in series. The first detection sub-circuit is coupled to the DC input terminal and the first containing area via the first resistor 231 and the second resistor 232 respectively.

The second detection sub-circuit is coupled to the second and fourth containing areas. Further, when the second containing area and the fourth containing area have the second lamp 213 and the fourth lamp 222 contained therein respectively, the second detection sub-circuit is also coupled to the second lamp 213 and the fourth lamp 222. It can be seen from FIG. 5 that the second detection sub-circuit comprises a third resistor 233, via which the second detection sub-circuit is coupled to the second and fourth containing areas. The first detection sub-circuit is connected in series with the second detection sub-circuit via the first inductor 211 and the second inductor 221.

In addition, the third detection sub-circuit is coupled to the third containing area and the latch circuit 24. It can be seen from FIG. 5 that the third detection sub-circuit comprises a fifth resistor 291, a sixth resistor 292, and a detection capacitor 294. The fifth resistor 291 is connected to the latch circuit 24 and the third containing area. The sixth resistor 292 is connected to the latch circuit 24 and the fifth resistor 291. The detection capacitor 294 is connected to the latch circuit 24 and the fifth resistor 291 and connected in parallel with the sixth resistor 292. Consequently, the third detection sub-circuit is coupled to the third containing area and the latch circuit 24 via the fifth resistor 291, the sixth resistor 292 and the detection capacitor 294.

In other words, when the third containing area has the third lamp 223 contained therein, the third detection sub-circuit is also coupled to the third lamp 223. The third detection sub-circuit is connected in series with the second detection sub-circuit via the filament 281 of the third lamp 223 and the lamp 280 of the second lamp 213.

With the above arrangement, the juncture 200, the first resistor 231, the second resistor 232, the filament 282 of the first lamp 212 contained in the first containing area, the first inductor 211, the second inductor 221, the filament 284 of the fourth lamp 222 contained in the fourth containing area, the third resistor 233, the filament 280 of the second lamp 213 contained in the second containing area, the filament 281 of the third lamp 223 contained in the third containing area, and the latch circuit 24 are connected together to form the aforementioned series circuit.

In a different way from that of the third embodiment, the detection circuit of the fourth preferred embodiment cascades the lamps contained in the containing areas of the first lamp set 21 and the second lamp set 22, the first inductor 211 and the second inductor 212 into a series circuit. Since all the lamps are disposed in the series circuit, failure of any of the lamps will change the operation status of the latch circuit 24.

Figure 6:
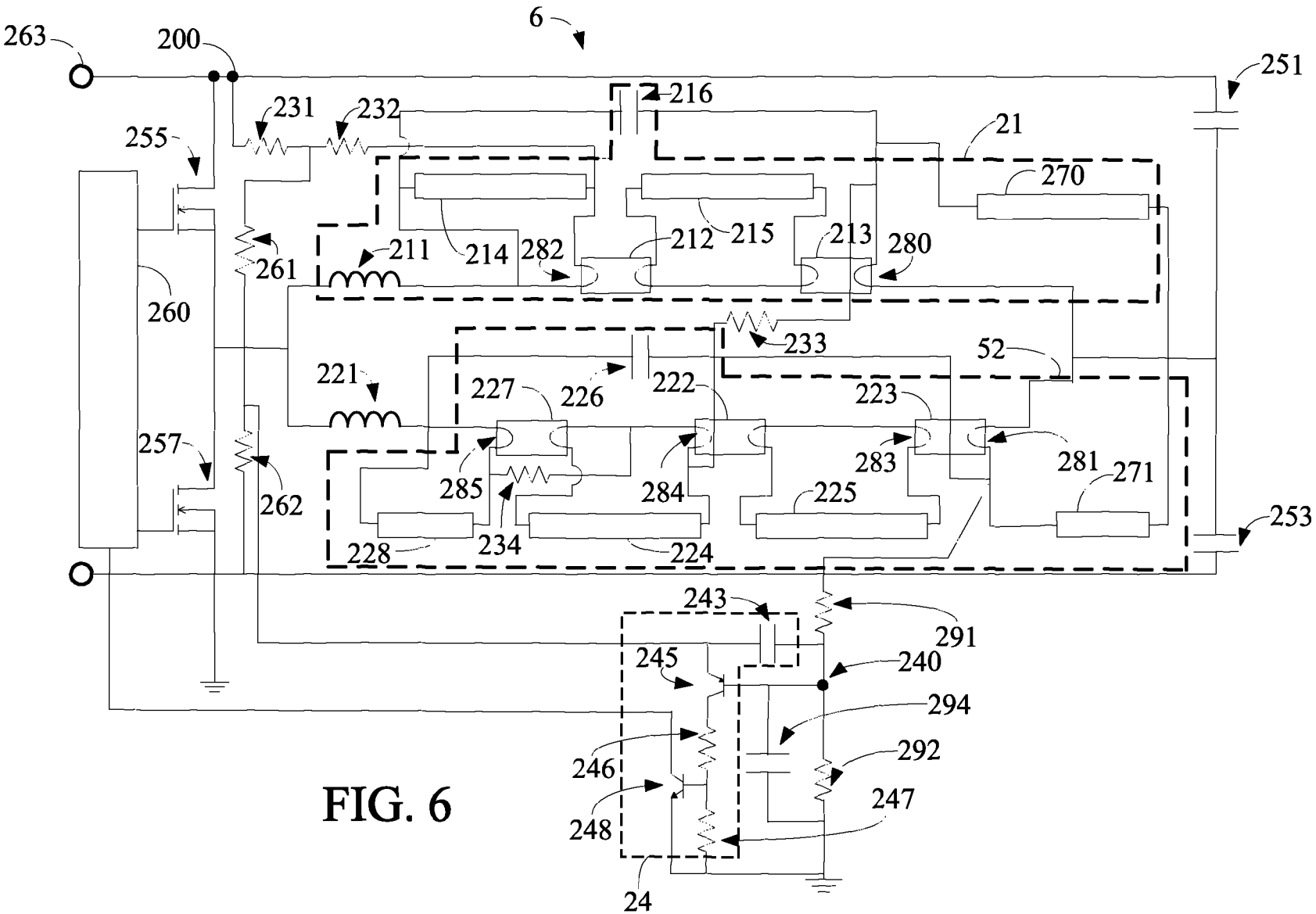
FIG. 6 is a schematic view of a fifth preferred embodiment of the present invention.

FIG. 6 illustrates a fifth preferred embodiment of the present invention, which is a ballast circuit 6. The ballast circuit 6 comprises a first lamp set 21, a second lamp set 52, a detection circuit, a latch circuit 24, capacitors 251, 253, and switches 255, 257. The first lamp set 21, the latch circuit 24, the capacitors 251, 253, the switches 255, 257, and their connections are just the same as those of the ballast circuit 5 of the fourth preferred embodiment, and thus will be omitted and not described again. The following descriptions will focus on differences between this embodiment and the fourth embodiment.

The first difference of the ballast circuit 6 and the ballast circuit 5 of the fourth preferred embodiment is in that the second lamp set 52 further comprises a preheat circuit 228 and a fifth containing area (not shown) for containing a fifth lamp 227. The containing areas (i.e., the third, the fourth and the fifth containing areas) included in the second lamp set 52 are connected in series with the second inductor 221, so that the third lamp 223, the fourth lamp 222, and the fifth lamp 227 contained therein are connected in series with the second inductor 221.

Specifically, the fifth containing area is coupled to the second inductor 221, and when the fifth containing area has the fifth lamp 227 contained therein, the fifth lamp 227 will also be coupled to the second inductor 221. The fourth lamp 222 is coupled to the fifth lamp 227, and the third lamp 223 is coupled to the fourth lamp 222 and the second lamp 213. Both the preheat circuits 224, 228 are coupled to the fifth lamp 227, and configured to preheat the fifth lamp 227 when the ballast circuit 6 is just started.

The second difference between the ballast circuit 6 and the ballast circuit 5 of the fourth preferred embodiment lies in connections of the detection circuit. The first detection sub-circuit is coupled to the first containing area and a DC voltage input terminal (e.g., the juncture 200, which is coupled to the DC voltage input terminal 263) to receive a DC voltage. Further, when the first containing area has the first lamp 212 contained therein, the first detection sub-circuit is also coupled to the first lamp 212. It can be seen from FIG. 6 that the first detection sub-circuit comprises the first resistor 231 and the second resistor 232 connected in series. Hence, the first detection sub-circuit is coupled to the DC input terminal and the first containing area via the first resistor 231 and the second resistor 232 respectively.

The second detection sub-circuit is coupled to the fifth containing area and the fourth containing area. Further, when the fifth containing area and the fourth containing area have the fifth lamp 227 and the fourth lamp 222 contained therein respectively, the second detection sub-circuit is also coupled to the fifth lamp 227 and the fourth lamp 222. It can be seen from FIG. 6 that the second detection sub-circuit comprises a fourth resistor 234, via which the second detection sub-circuit is coupled to the fifth and the fourth containing areas. It should be noted that the first detection sub-circuit is connected in series with the second detection sub-circuit via the filament 282 of the first lamp 212, the first inductor 211, the second inductor 221, and the filament 285 of the fifth lamp 227.

The third detection sub-circuit is coupled to the fourth containing area and the second containing area. Further, when the fourth containing area and the second containing area have the fourth lamp 222 and the second lamp 213 contained therein respectively, the third detection sub-circuit is also coupled to the fourth lamp 222 and the second lamp 213. It can be seen from FIG. 6 that the third detection sub-circuit comprises a third resistor 233, via which the third detection sub-circuit is coupled to the fourth and the second containing areas. It should be noted that the third detection sub-circuit is connected in series with the second detection sub-circuit via the filament 284 of the fourth lamp 222.

Additionally, the fourth detection sub-circuit is coupled to the third containing area and the latch circuit 24. It can be seen from FIG. 6 that the fourth detection sub-circuit comprises a fifth resistor 291, a sixth resistor 292, and a detection capacitor 294. The fifth resistor 291 is connected to the latch circuit 24 and the third containing area. The sixth resistor 292 is connected to the latch circuit 24 and the fifth resistor 291. The detection capacitor 294 is connected to the latch circuit 24 and the fifth resistor 291 and connected in parallel with the sixth resistor 292. Consequently, the fourth detection sub-circuit is coupled to the third containing area and the latch circuit 24 via the fifth resistor 291, the sixth resistor 292, and the detection capacitor 294.

In other words, when the third containing area has the third lamp 223 contained therein, the fourth detection sub-circuit is also coupled to the third lamp 223. The fourth detection sub-circuit is connected in series with the third detection sub-circuit via the filament 281 of the third lamp 223 and the filament 280 of the second lamp 213.

With the above arrangement, the juncture 200, the first resistor 231, the second resistor 232, the filament 282 of the first lamp 212 contained in the first containing area, the first inductor 211, the second inductor 221, the filament 285 of the fifth lamp 227 contained in the fifth containing area, the fourth resistor 234, the filament 284 of the fourth lamp 222 contained in the fourth containing area, the third resistor 233, the filament 280 of the second lamp 213 contained in the second containing area, the filament 281 of the third lamp 223 contained in the third containing area, the fifth resistor 291, the sixth resistor 292 and the latch circuit 24 are connected together to form the aforementioned series circuit.

According to the aforementioned descriptions, by use of the first inductor 211 and the second inductor 221, the detection circuit cascades all lamps contained in the containing areas into a series circuit no matter how many lamps are included in the first and the second lamp sets. Consequently, failure of any of the lamps will change the operation status of the latch circuit 24.

This invention relates to a ballast circuit which, by use of a detection circuit coupled to each lamp contained in the containing areas of the ballast circuit, is able to detect if all the lamps are connected into the circuit. Once all the lamps are connected into the circuit, the ballast circuit may restart all the lamps of the ballast circuit by turning on a latch circuit. As a result, the problem that conventional ballast circuits fail to detect if all the lamps are connected into the circuit can be effectively solved by this invention.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A ballast circuit, comprising, a first lamp set, comprising:

a first inductor; and a plurality of containing areas, each of the containing areas being adapted to contain a lamp so that the lamps are connected in series, and the containing areas being connected in series with the first inductor;

a second lamp set being connected in parallel with the first lamp set, comprising:

a second inductor, being coupled to the first inductor;

at least one containing area, being connected in series with the second inductor, each of the at least one containing area being adapted to contain a lamp so that the at least one lamp is connected in series with the second inductor;

a detection circuit, being coupled to each of the containing areas of the first lamp set and each of the containing areas of the second lamp set so that the detection circuit, the first inductor, the second inductor, and the lamps contained in the containing areas form a series connection, the detection circuit being configured to receive a direct current (DC) voltage signal and to generate a first signal; and a latch circuit coupled to the detection circuit, being configured to receive the first signal from the detection circuit and selectively start the ballast circuit in response to the first signal.

2. The ballast circuit of claim 1, wherein the containing areas of the first lamp set include a first containing area containing a first lamp and a second containing area containing a second lamp, the first containing area is connected to the first inductor, the second containing area is connected to the first containing area, and the at least one containing area of the second lamp set includes a third containing area containing a third lamp, the third containing area being coupled to the second inductor and the second containing area, the detection circuit comprises:

a first detection sub-circuit, being connected to a DC voltage input terminal and the second containing area, wherein the DC voltage signal is received from the DC voltage input terminal;

a second detection sub-circuit, being connected to the first containing area and the third containing area; and a third detection sub-circuit, being connected to the third containing area and the latch circuit;

wherein the first detection sub-circuit, the second lamp, the third lamp, the second detection sub-circuit, the first lamp, the first inductor, the second inductor, and the third detection sub-circuit are connected in series.

3. The ballast circuit of claim 2, wherein the first detection sub-circuit comprises a first resistor and a second resistor connected in series with the first resistor, and the first detection sub-circuit is connected to the DC voltage input terminal and the second containing area via the first resistor and the second resistor respectively.

4. The ballast circuit of claim 2, wherein the second detection sub-circuit comprises a third resistor, and the second detection sub-circuit is connected to the first containing area and the third containing area via the third resistor.

5. The ballast circuit of claim 2, wherein the third detection sub-circuit comprises:

a fifth resistor, being connected to the latch circuit and the third containing area;

a sixth resistor, being connected to the fifth resistor in series at a juncture; and a detection capacitor, being connected in parallel with the sixth resistor so that the third detection sub-circuit is coupled to the third containing area and the latch circuit via the fifth resistor, the sixth resistor, and the detection capacitor so that the latch circuit selectively starts the ballast circuit in response to the first signal at the juncture.

6. The ballast circuit of claim 1, wherein the containing areas of the first lamp set include a first containing area containing a first lamp and a second containing area containing a second lamp, the first containing area is connected to the first inductor, the second containing area is connected to the first containing area, and the at least one containing area of the second lamp set includes a third containing area containing a third lamp, the third containing area being connected to the second inductor and the second containing area, the detection circuit comprises:

a first detection sub-circuit, being connected to a DC voltage input terminal and the first containing area, wherein the DC voltage signal is received from the DC voltage input terminal;

a second detection sub-circuit, being connected to the second containing area and the third containing area; and a third detection sub-circuit, being connected to the third containing area and the latch circuit; and wherein the first detection sub-circuit, the first lamp, the first inductor, the second inductor, the third lamp, the second detection sub-circuit, the second lamp, and the third detection sub-circuit are connected in series.

7. The ballast circuit of claim 6, wherein the first detection sub-circuit comprises a first resistor and a second resistor connected in series with the first resistor, and the first detection sub-circuit is connected to the DC voltage input terminal and the first containing area via the first resistor and the second resistor respectively.

8. The ballast circuit of claim 6, wherein the second detection sub-circuit comprises a third resistor, and the second detection sub-circuit is connected to the second containing area and the third containing area via the third resistor.

9. The ballast circuit of claim 6, wherein the third detection sub-circuit comprises:

a fifth resistor, being connected to the latch circuit and the third containing area;

a sixth resistor, being connected to the fifth resistor in series at a juncture; and a detection capacitor, being connected in parallel with the sixth resistor so that the third detection sub-circuit is connected to the third containing area and the latch circuit via the fifth resistor, the sixth resistor, and the detection capacitor so that the latch circuit selectively starts the ballast circuit in response to the first signal at the juncture.

10. The ballast circuit of claim 1, wherein the second lamp set comprises a plurality of containing areas connected in series with the second inductor, each of the containing areas is adapted to contain a lamp, so that the lamps contained in the containing areas of the second lamp set are connected in series with the second inductor.

11. The ballast circuit of claim 10, wherein the containing areas of the first lamp set include a first containing area containing a first lamp and a second containing area containing a second lamp, the first containing area is connected in series with the first inductor and the second containing area, the containing areas of the second lamp set include a third containing area containing a third lamp and a fourth containing area containing a fourth lamp, the fourth containing area is connected in series with the second inductor and the third containing area, and the detection circuit comprises:

a first detection sub-circuit, being connected to a DC voltage input terminal and the second containing area, wherein the DC voltage signal is received from the DC voltage input terminal;

a second detection sub-circuit, being coupled to the first containing area and the third containing area; and a third detection sub-circuit, being coupled to the fourth containing area and the latch circuit;

wherein the first detection sub-circuit, the second lamp, the third lamp, the second detection sub-circuit, the first lamp, the first inductor, the second inductor, the fourth lamp, and the third detection sub-circuit are connected in series.

12. The ballast circuit of claim 11, wherein the first detection sub-circuit comprises a first resistor and a second resistor connected in series with the first resistor, and the first detection sub-circuit is connected to the DC voltage input terminal and the second containing area via the first resistor and the second resistor respectively.

13. The ballast circuit of claim 11, wherein the second detection sub-circuit comprises a third resistor, and the second detection sub-circuit is coupled to the first containing area and the third containing area via the third resistor.

14. The ballast circuit of claim 11, wherein the third detection sub-circuit comprises:

a fifth resistor, being connected to the latch circuit and the fourth containing area;

a sixth resistor, being connected to the fifth resistor in series at a juncture; and a detection capacitor, being connected to the latch circuit and the fifth resistor and connected in parallel with the sixth resistor, so that the third detection sub-circuit is coupled to the fourth containing area and the latch circuit via the fifth resistor, the sixth resistor and the detection capacitor so that the latch circuit selectively starts the ballast circuit in response to the first signal at the juncture.

15. The ballast circuit of claim 10, wherein the containing areas of the first lamp set include a first containing area containing a first lamp and a second containing area containing a second lamp, the first containing area is connected to the first inductor, the second containing area is connected to the first containing area, the containing areas of the second lamp set include a third containing area containing a third lamp and a fourth containing area containing a fourth lamp, the fourth containing area is connected to the second inductor, the third containing area is connected to the fourth containing area and the second containing area, and the detection circuit comprises:

a first detection sub-circuit, being connected to a DC voltage input terminal and the first containing area, wherein the DC voltage signal is received from the DC voltage input terminal;

a second detection sub-circuit, being connected to the second containing area and the fourth containing area; and a third detection sub-circuit, being connected to the third containing area and the latch circuit;

wherein the first detection sub-circuit, the first lamp, the first inductor, the second inductor, the fourth lamp, the second detection sub-circuit, the second lamp, the third lamp, and the third detection sub-circuit are connected in series.

16. The ballast circuit of claim 10, wherein the containing areas of the first lamp set include a first containing area containing a first lamp and a second containing area containing a second lamp, the first containing area is connected to the first inductor, the second containing area is connected to the first containing area, the containing areas of the second lamp set include a third containing area containing a third lamp, a fourth containing area containing a fourth lamp, and a fifth containing area containing a fifth lamp, the fifth containing area is connected to the second inductor, the fourth containing area is connected to the fifth containing area, the third containing area is connected to the fourth containing area and the second containing area, and the detection circuit comprises:

a first detection sub-circuit, being connected to a DC voltage input terminal and the first containing area, wherein the DC voltage signal is received from the DC voltage input terminal;

a second detection sub-circuit, being connected to the fifth containing area and the fourth containing area;

a third detection sub-circuit, being connected to the fourth containing area and the second containing area; and a fourth detection sub-circuit, being connected to the third containing area and the latch circuit;

wherein the first detection sub-circuit, the first lamp, the first inductor, the second inductor, the fifth lamp, the second detection sub-circuit, the fourth lamp, the third detection sub-circuit, the second lamp, the third lamp, and the fourth detection sub-circuit are connected in series.

17. The ballast circuit of claim 10, wherein the first lamp set further comprises a first capacitor connected to the containing areas of the first lamp set and the first inductor, and the second lamp set further comprises a second capacitor connected to the containing areas of the second lamp set and the second inductor.

18. The ballast circuit of claim 1, wherein the first lamp set further comprises a plurality of preheat circuits, each of the preheat circuits of the first lamp set is connected to one of the containing areas of the first lamp set respectively, the second lamp set further comprises a plurality of preheat circuits, and each of the preheat circuits of the second lamp set is connected to one of the at least one containing area of the second lamp set respectively.

* * * * *